US006518934B1

(12) United States Patent
Knowles et al.

(10) Patent No.: US 6,518,934 B1
(45) Date of Patent: Feb. 11, 2003

(54) PARASITICALLY DRIVEN DIPOLE ARRAY

(75) Inventors: Patrick J. Knowles, Gambrills, MD (US); David P. Lopez, Columbia, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/003,185

(22) Filed: Oct. 29, 2001

(51) Int. Cl.[7] ..... H01Q 9/16
(52) U.S. Cl. ..... 343/801; 343/813; 343/827
(58) Field of Search ..... 343/801, 802, 343/793, 795, 810, 813, 814, 815, 825, 827

(56) References Cited

U.S. PATENT DOCUMENTS 3,899,787 A 8/1975 Czerwinski ..... 343/790
4,369,449 A 1/1983 MacDougall ..... 343/790
4,479,130 A * 10/1984 Snyder ..... 343/802
4,872,021 A * 10/1989 Tabakov et al. ..... 343/801
5,387,919 A * 2/1995 Lam et al. ..... 343/821
5,898,411 A * 4/1999 McGaffigan et al. ..... 343/801
6,057,804 A 5/2000 Kaegebein ..... 343/792

* cited by examiner

*Primary Examiner*—Hoang Nguyen
(74) *Attorney, Agent, or Firm*—Birch, Stewart, Kolasch & Birch, LLP

(57) ABSTRACT

A steerable dipole array including a plurality of end loaded electrically short dipole antenna sections arranged along a common longitudinal axis. The antenna sections include active transmit/receive modules with a common DC power line used to power the modules being used as part of the radiating system while for maintaining DC continuity in the DC power line.

The DC power line includes a pair of capacitively coupled electrical conductors extending in an axial direction adjacent the antenna sections and having RF chokes formed therein located adjacent the outer end portions of the antenna sections for reducing the mutual coupling between the electrical conductors and dipole antenna sections.

25 Claims, 12 Drawing Sheets

IDEAL DIPOLE
SCAN = 0°

IDEAL DIPOLE
SCAN = 35°

IDEAL DIPOLE
SCAN = 90°

IDEAL DIPOLE WITH DC SCAN = 0°

IDEAL DIPOLE WITH DC SCAN = 35°

IDEAL DIPOLE WITH DC SCAN = 90°

IDEAL DIPOLE,
SCAN = 0 DEG.
AIR GAP IN DC WIRE

IDEAL DIPOLE,
SCAN = 35 DEG.
AIR GAP IN DC WIRE

IDEAL DIPOLE,
SCAN = 60 DEG.
AIR GAP IN DC WIRE

SHORTENED ELEMENT,
SCAN = 0 DEG.
AIR GAP IN DC WIRE

SHORTENED ELEMENT,
SCAN = 35 DEG.
AIR GAP IN DC WIRE

SHORTENED ELEMENT,
SCAN = 60 DEG.
AIR GAP IN DC WIRE

PARASITICALLY DRIVEN DIPOLE ARRAY

BACKGROUND OF THE INVENTION

1. Field of the Invention

This invention relates generally to antenna systems for radiating and receiving RF energy and more particularly to an axial parasitically driven dipole antenna array.

2. Description of Related Art

As is well known, an antenna is an electrical element which can either radiate or collect electromagnetic energy. A transmitting antenna converts electrical energy from a signal source into electromagnetic waves of radio frequency (RF) energy which radiate away from the antenna either omnidirectionally or directionally depending upon the design. A receiving antenna, on the other hand, converts received RF energy into electrical energy which is coupled to RF receiver apparatus. Some antennas are adapted to serve both as transmitting and receiving antennas and are coupled to electrical apparatus which is adapted to both send and receive RF signals.

One such antenna comprises a half wave dipole antenna which consists of two quarter wave conductors linearly aligned and having the inner extremities which are excited by an RF generator. Such apparatus is well known to those skilled in the art and is well documented in the literature. Additionally, dipole antenna systems including one or more axially aligned dipoles for operating in the UHF and/or VHF frequency bands are also well known. One such antenna system is disclosed in U.S. Pat. No. 3,899,787, issued to W. P. Czerwinski on Aug. 12, 1975. The Czerwinski patent discloses a triplex antenna system comprising at least three individually excited tubular dipole antennas vertically oriented in an in-line configuration inside of a tubular radome and spaced approximately one wavelength apart. A coaxial sleeve approximately a quarter wavelength long is additionally mounted exteriorally of and is associated with each tubular radiating element inside of the radome for broadbanding the feed-point impedance of the respective dipole antennas.

Another example of an axial dipole antenna array is disclosed in U.S. Pat. No. 4,369,449, issued to J. B. McDougall on Jan. 18, 1983. There a linearly polarized omnidirectional antenna system is disclosed which includes one or more dipoles having an elongated tubular conductive radiator having a length that is about one half wavelength of the midband frequency and an elongated inner conductor member extending longitudinally through the interior of the radiator and spaced therefrom. A coaxial cable or other feed means conduct signals to and from one end of the radiator and to and from the inner conductor member. The impedances of the dipole and feed means are matched over a selected frequency band, such as by the use of a series inductive reactance between the feed means and the radiator. Two such dipoles can be connected to a colinear, center-fed pair, and two or more such dipoles can be arranged in the co-linear array having a common inner conductor member.

SUMMARY

It is an object of the present invention, therefore, to provide an improvement in steerable axial dipole antenna arrays including active T/R modules which are powered by a DC power line consisting of a pair of elongated wire type conductors that tend to interact with the RF radiator so as to effectively short out the elements by the strong RF image produced by the electrically close DC wires.

Accordingly, this invention is directed to a method and apparatus by which the DC wires are used as part of the radiating system while maintaining DC continuity so that instead of shorting out the radiating elements, array performance is enhanced over the classic dipole array.

In one aspect of the invention, it is directed to an axial dipole antenna array, comprising: a plurality of spaced apart parasitically driven dipole antenna sections arranged linearly along a common longitudinal axis wherein each of the antenna sections include a pair of end loaded electrically short antenna dipole leg elements having an electrical length substantially less than a quarter wavelength ($\lambda/4$), for example, less than one tenth wavelength ($0.1\lambda$), a respective active transmit/receive module connected to the dipole leg elements and located in the immediate vicinity thereof, and a pair of capacitively coupled continuous electrical conductor members extending in an axial direction adjacent the dipole leg elements of the plurality of antenna sections for supplying DC power thereto and including RF chokes located adjacent the outer end portions of both of the dipole leg elements for restricting the electric length of the portion of the electrical conductors extending past the leg elements so that it is equal to or less than a half wavelength ($\lambda/2$) for reducing the mutual coupling between the electrical conductors and the leg elements while at the same time forming a parasitic element for the respective dipole antenna section.

In another aspect of the invention, it is directed to a method of forming a dipole antenna array and comprises the steps of: arranging a plurality of parasitically driven dipole antenna sections linearly along a common longitudinal axis and where each of the sections include a pair of electrically short antenna dipole leg elements having an electrical length equal to or less than one tenth wavelength ($0.1\lambda$), and loading the dipole leg elements with coiled inductive type elements, locating respective active transmit/receive modules in the immediate vicinity of the dipole leg elements, connecting the transmit/receive modules to the respective leg elements, installing a pair of capacitively coupled continuous electrical conductors in the axial direction adjacent the dipole leg elements for supplying DC power to the respective transmit/receive modules, and locating an RF choke immediately adjacent the outer ends of both dipole leg elements for restricting the electrical length of the portion of the electrical conductors extending past the leg elements so that it is equal to or less than a half wavelength for reducing the mutual coupling between the electrical conductors and the leg elements while forming a parasitic element for the respective dipole antenna section.

Further scope of applicability of the present invention will become apparent from the detailed description provided hereinafter. It should be understood, however, that the detailed description and specific examples, while disclosing the preferred embodiments of the invention, it is given by way of illustration only, since various changes and modifications coming within the spirit and scope of the invention will become apparent to those skilled in the art.

BRIEF DESCRIPTION OF THE DRAWING

The present invention will become more fully understood from the detailed description provided hereinbelow when considered in conjunction with the accompanying drawings which are provided by way of illustration only, and thus are not meant to be limitative of the present invention, and wherein.

DETAILED DESCRIPTION OF THE INVENTION

Many antenna applications require arrays with steerable azimuth and/or elevation coverage. An efficient solution is to provide a steerable dipole array that is axial. This implies that the legs of the dipole elements are coaligned along a common axis. In such an arrangement, the drive points of the elements are now floating in space with no ground plane to conceal the RF manifold. A transmit/receive module at each drive location also solves the RF problem; however, the DC lines or electrical conductors required to provide power to the modules interact with the RF radiator to effectively short out the elements by a strong RF image produced in the electrically close DC conductors.

This invention is directed to a method and apparatus which uses the conductors of the DC power line as part of the radiating system while maintaining DC continuity and wherein, instead of shorting out the radiating elements, they enhance array performance.

Figure 1:
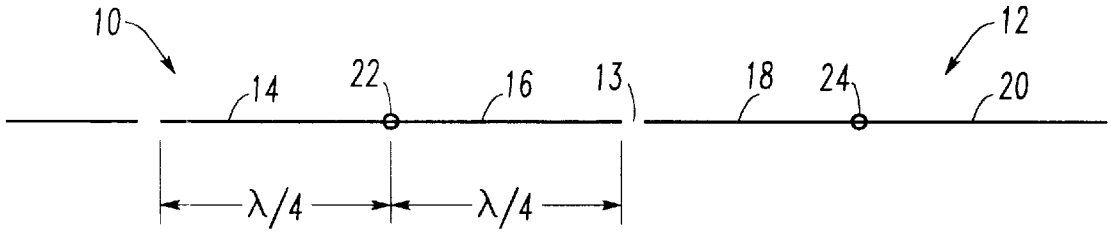
FIG. 1 PRIOR ART
FIG. 1 is schematically illustrative of an axially aligned dipole system in accordance with the known prior art.
Figure 2A:
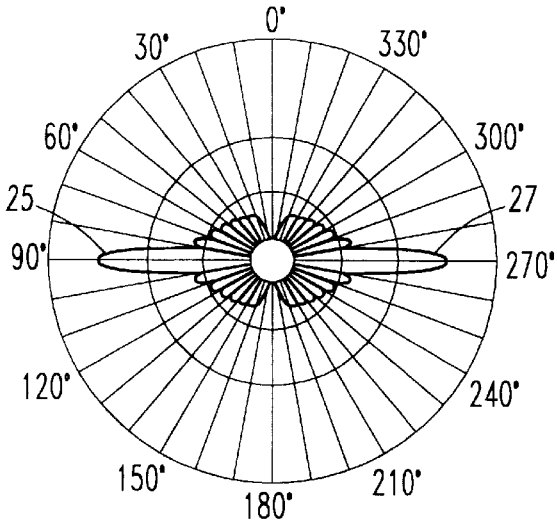
FIGS. 2A–2C depict antenna patterns for three scan angles of the dipole antenna system shown in FIG. 1.
Figure 2B:
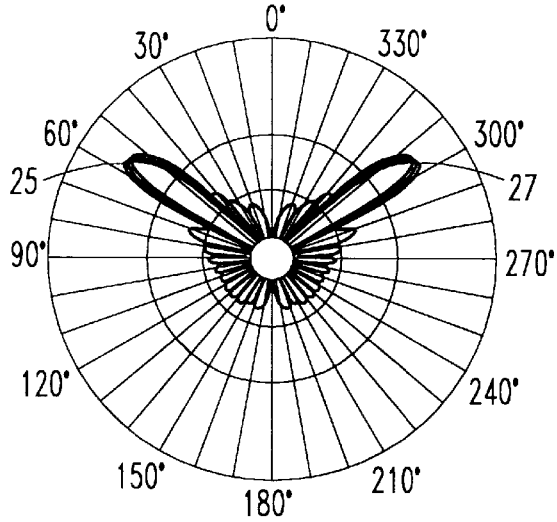
Figure 2C:
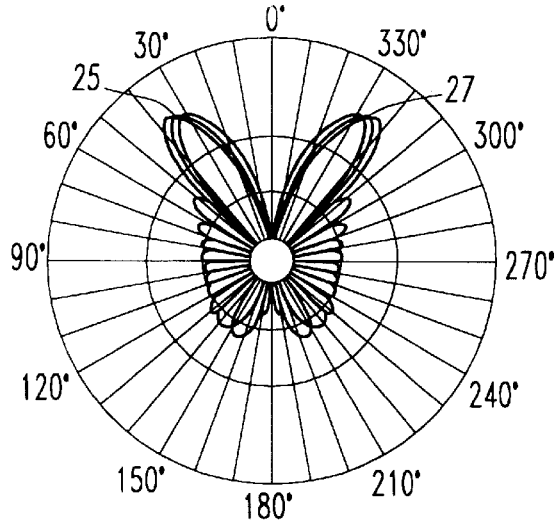

Referring now to the drawing figures wherein like reference numerals refer to like components, FIG. 1 is illustrative of an axial dipole array wherein two aligned dipole radiator sections 10 and 12 of a plurality of antenna sections are shown including slightly less than quarter wavelength ($\lambda/4$) leg elements 14, 16 and 18, 20 connected to RF feed points 22 and 24 which are typically located approximately one half wavelength ($\lambda/2$) apart. The dipole configuration shown in FIG. 1 represents a typical ideal dipole antenna. Scanning of such an antenna can be achieved by suitable phasing the RF signals applied to the various feedpoints such as the feedpoints 22 and 24. FIGS. 2A, 2B, and 2C depict three antenna patterns for a 0° scan, a 30° scan and a 60° scan, respectively.

Figure 4A:
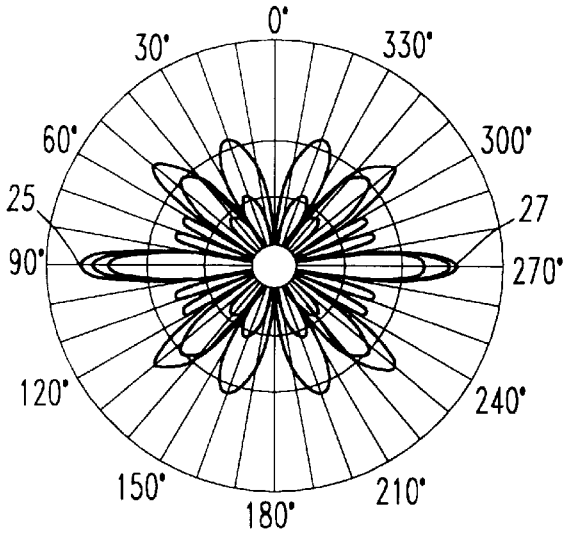
FIGS. 4A–4C depict antenna patterns for three scan angles of the dipole antenna system shown in FIG. 3.
Figure 4B:
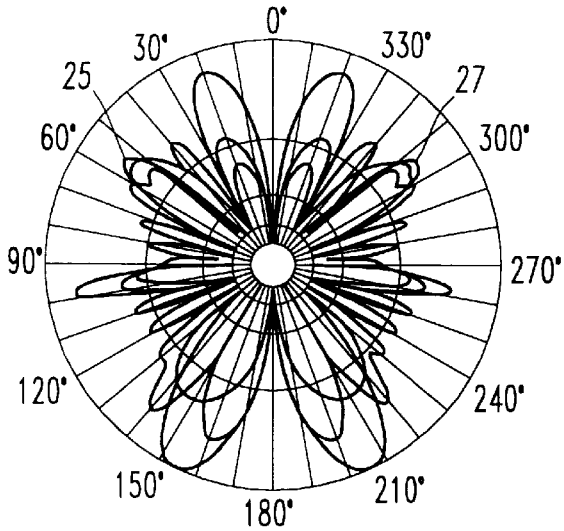
Figure 4C:
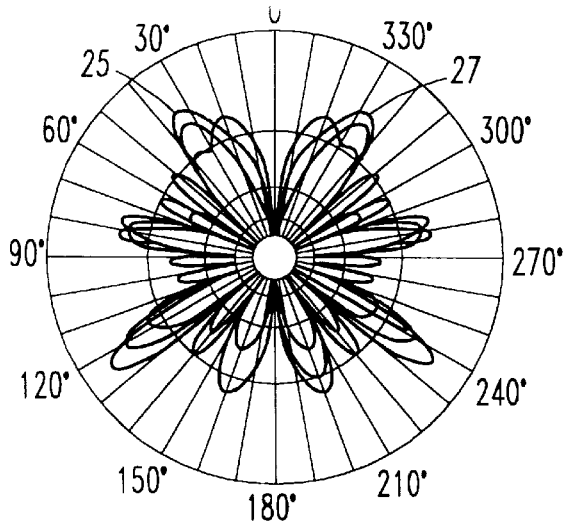

If, however, an axial dipole array such as partially shown in FIG. 2 has a continuous DC power line 28 consisting of, for example, two capacitively coupled DC wires or conductors 30 and 32, very strong mutual coupling occurs between the leg element 14, 16, and 28,20, and a self image in the DC supply element 28. Such an arrangement deteriorates the scan patterns of FIGS. 2A–2C as shown in FIGS. 4A–4C where the secondary lobes tend to swamp the main lobes 25 and 27.

Figure 5:
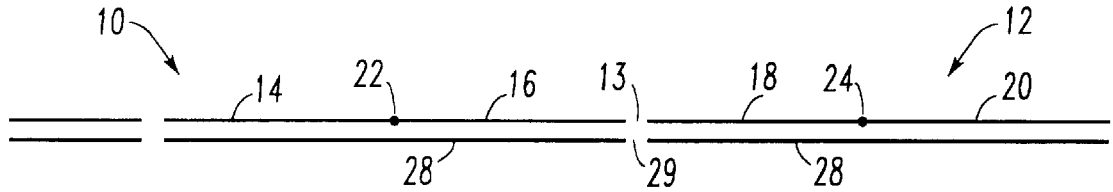
FIG. 5 PRIOR ART
FIG. 5 is a schematic diagram of the dipole antenna system shown in FIG. 3 where a gap is formed in the continuous DC conductor shown in FIG. 3 at the ends of the dipole legs.
Figure 6A:
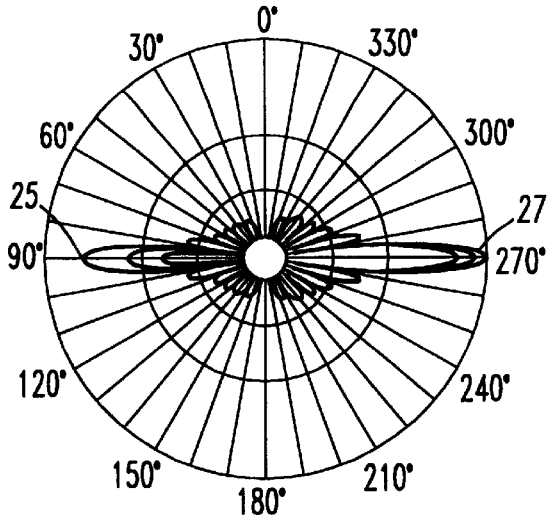
FIGS. 6A–6C are illustrative of three antenna patterns for three scan angles of the antenna system shown in FIG. 5.
Figure 6B:
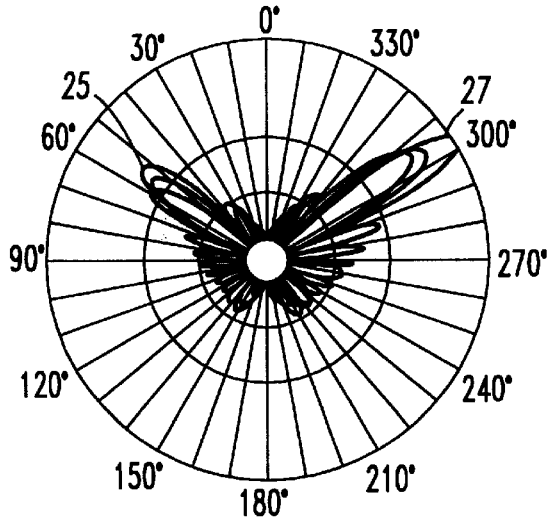
Figure 6C:
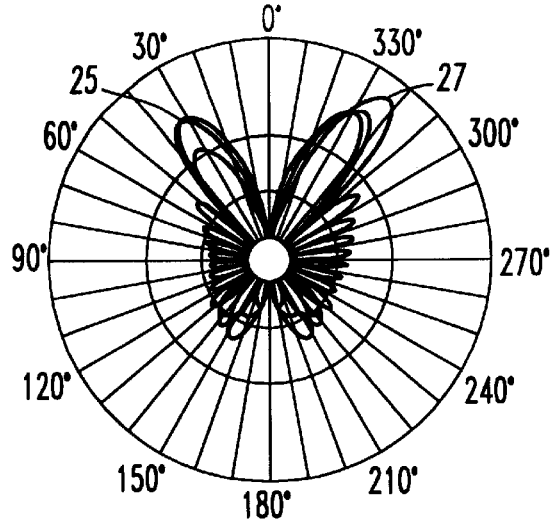

One solution to the problem of a continuous DC supply line 28 is to cut the supply line 28 at, for example, at the space 29 between mutually opposing dipole leg elements 16 and 18, as shown in FIG. 5, meaning that for an array of a plurality of dipole sections, the DC line would be cut at the ends of the dipole leg elements. Such an arrangement would result in antenna patterns for a 0° scan, a 60° scan, and a 30° scan as shown in FIGS. 6A, 6B and 6C, respectively. While such an arrangement would solve the RF problem, the DC power line 28 is no longer continuous which is necessary where active T/R modules are part of each antenna section.

The present invention is directed to the concept of reducing the coupling region where the driven elements 14, 16, and 18, 20 and the DC line 28 interact with each other. This involves utilizing a modified (electrically short) floating dipole antenna section having leg elements which have a geometry that resonates at the same desired frequency band yet occupies a shorter length over the DC line and thereby reduce mutual coupling. Such an arrangement is shown in FIG. 7 where, for example, modified dipole antenna sections 10' and 12' and consisting of leg elements 14', 16' and 18', 20' have a combined electrical length of less than $0.1\lambda$.

Figure 8A:
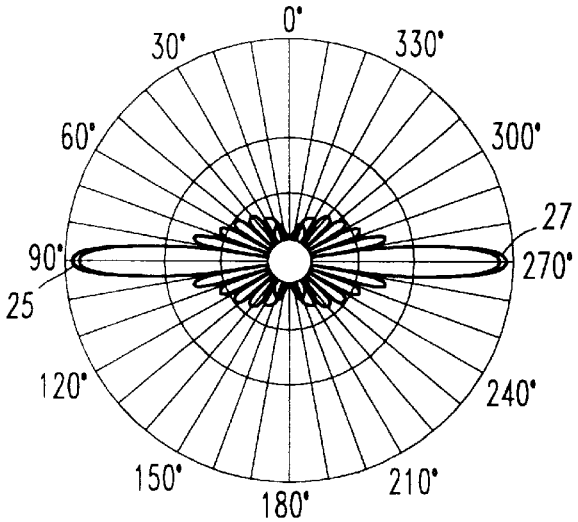
FIGS. 8A–8C are illustrative of antenna patterns for three scan angles of the antenna system shown in FIG. 7.
Figure 8B:
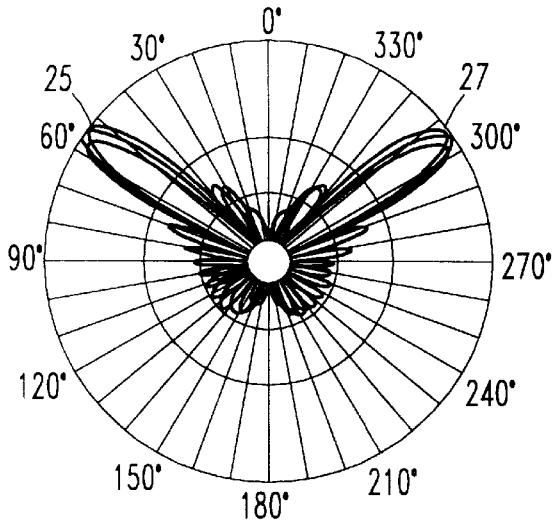
Figure 8C:
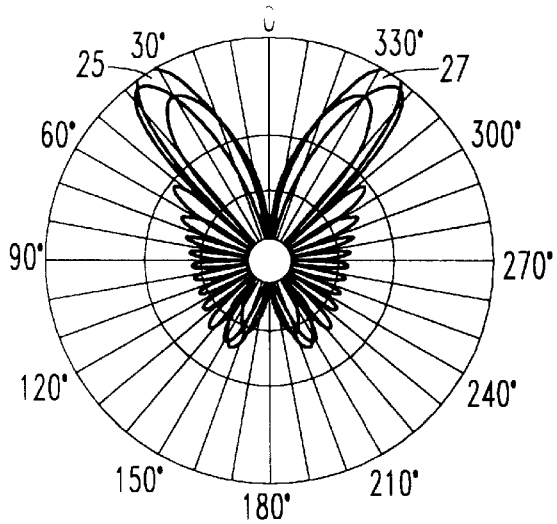
Figure 13:
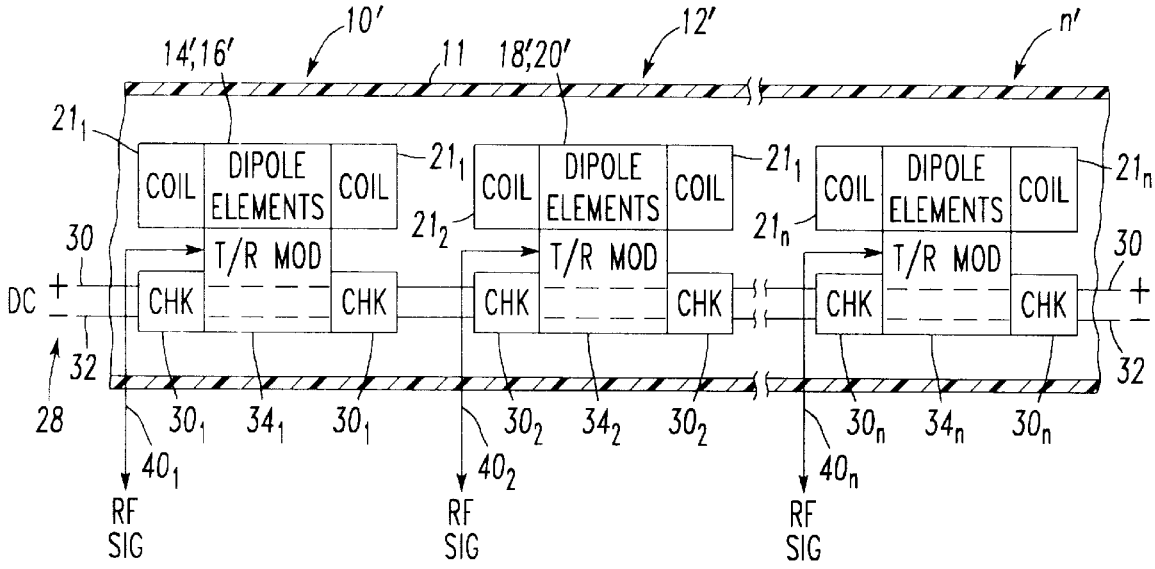
FIG. 13 is an electrical block diagram of the preferred embodiment of the invention shown in FIG. 11.
Figure 14:
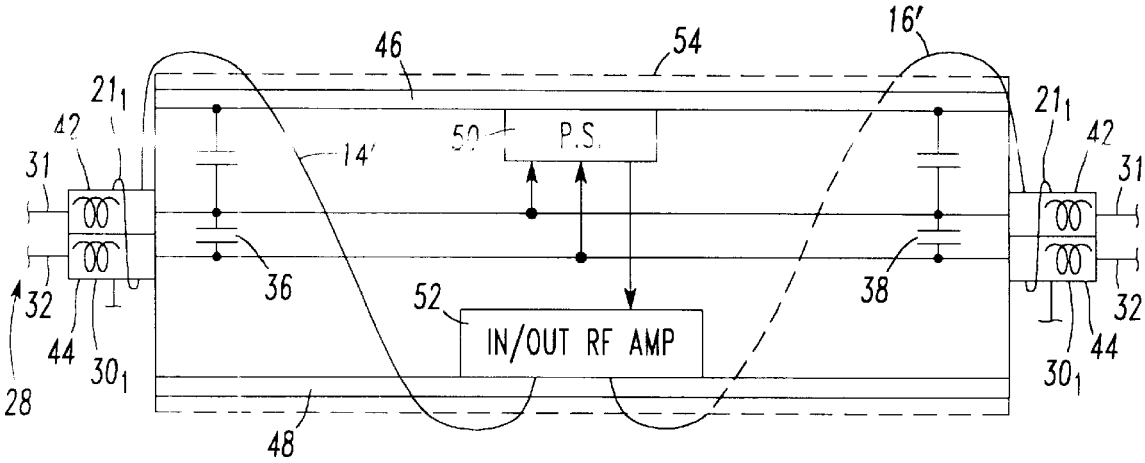
FIG. 14 is an electrical schematic diagram illustrative of capacitive coupling between the pair of conductors of the DC power line utilized in connection with the preferred embodiment of the subject invention shown in FIGS. 13 and 14.
Figure 15:
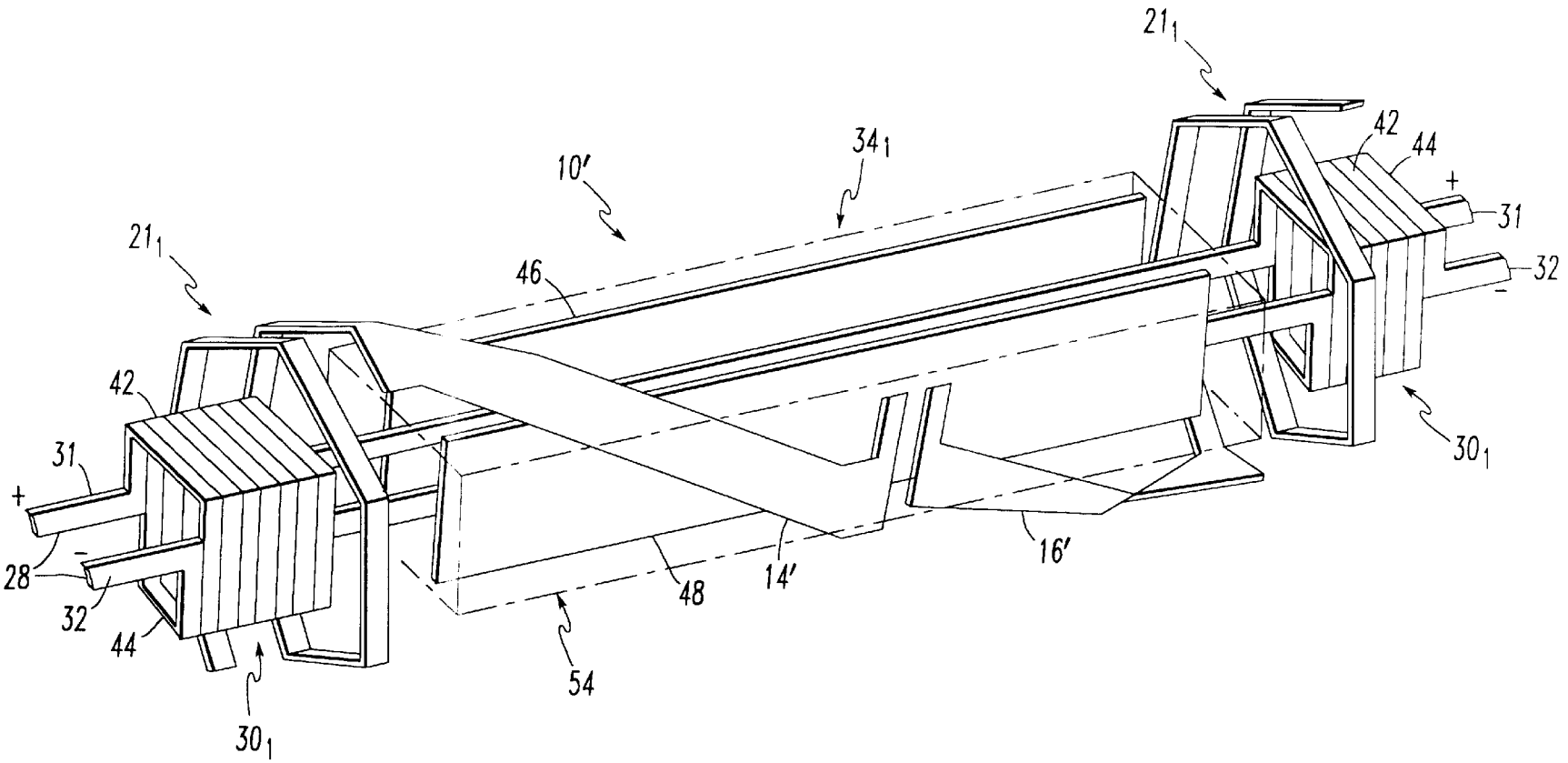
FIG. 15 is a perspective view of one dipole antenna section of the preferred embodiment shown in FIGS. 11 and 13.

However, such elements have an electrical length which is too short to resonate at mid-band of the desired operating frequency. End loading is thus required, and in the subject invention involves coiled end loading including loading coils 21 wound in an opposite sense with respect to each other and connected to the outer ends of the dipole leg elements such as shown in FIGS. 13–15, to be considered hereinafter. Such a configuration where the air gap 29 still exists in the electrical line 28, produces enhanced antenna patterns shown in FIGS. 8A, 8B and 8C for a 0° scan, 30° scan and 60° scan.

Figure 3:
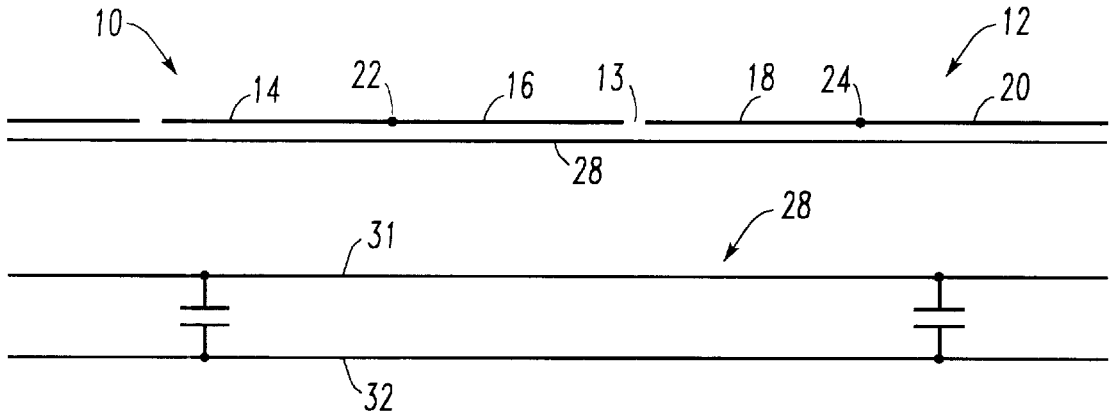
FIG. 3 PRIOR ART
FIG. 3 is a schematic diagram of the dipole antenna system shown in FIG. 1 subtended by a pair of wire conductors of a continuous DC power line.

Such an embodiment, however, does not address the secondary mode excited along the long continuous DC power line 28 (FIG. 3). A solution to this problem is to prevent energy from exciting the secondary mode. This is accomplished in the subject invention by guaranteeing that no section of the DC line 28 is electrically longer than one half wavelength ($\lambda/2$). While the embodiments shown in FIGS. 5 and 7, for example, can provide DC line sections which are no longer a $\lambda/2$, the DC line 28, however, is not continuous.

Figure 7:
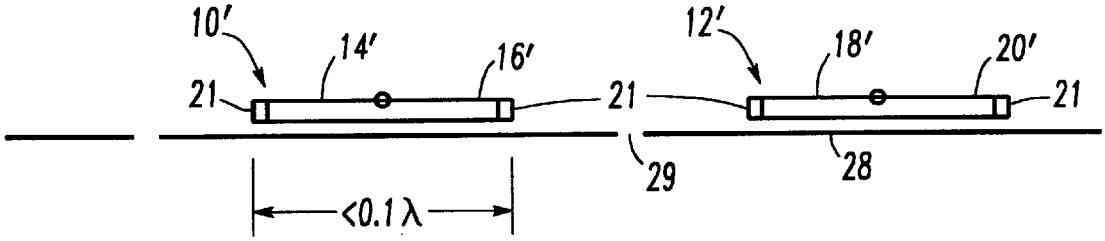
FIG. 7 is an electrical schematic diagram of a dipole antenna system shown in FIG. 5 where modified dipole elements replace those of FIG. 5.
Figure 9:
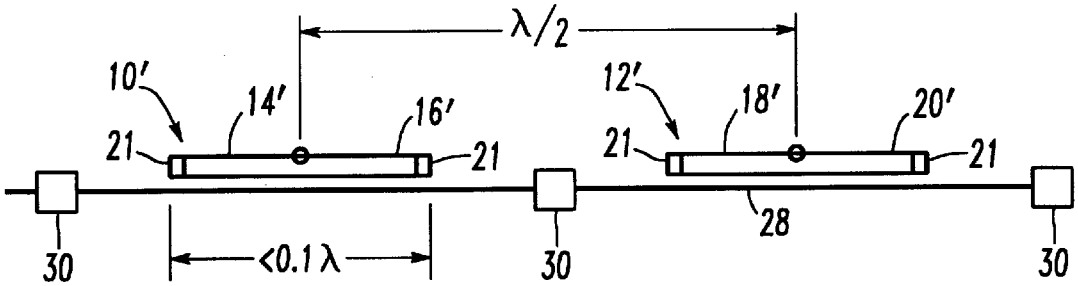
FIG. 9 is a schematic diagram of a dipole antenna system shown in FIG. 7 where continuous DC power lines are again included but now having RF chokes therein located on either side of the dipole leg elements.
Figure 10A:
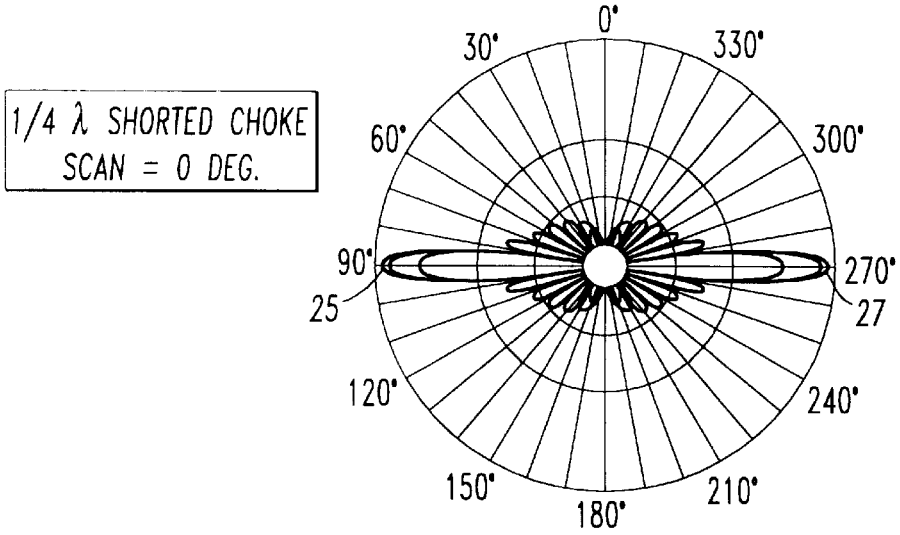
FIGS. 10A–10C are illustrative of antenna patterns for three scan angles of the antenna system shown in FIG. 9.
Figure 10B:
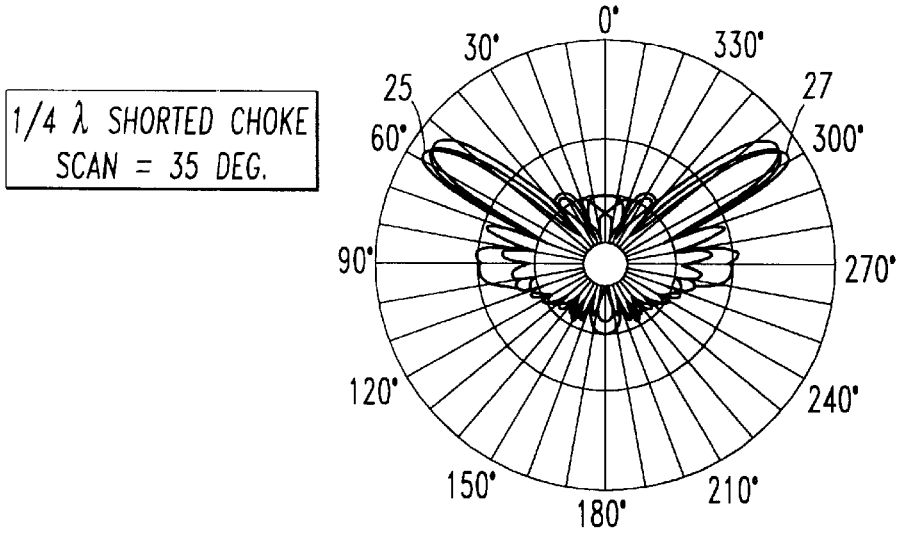

The present invention partially solves the discontinuity problem by including RF chokes 30, as shown in FIG. 9, at the location of the air gaps 29 shown in FIG. 7. The RF choke 30 is adapted to simulate the air gap 29 by providing isolation greater than 25 dB and a specific electrical delay. Accordingly, the choke 30 is designed so as to have a complex transfer function consisting of a lump inductance response and an electrical delay associated therewith. Accordingly, scan patterns for 0°, 30° and 60° scans generate patterns shown in FIGS. 10A, 10B and 10C.

Figure 11:
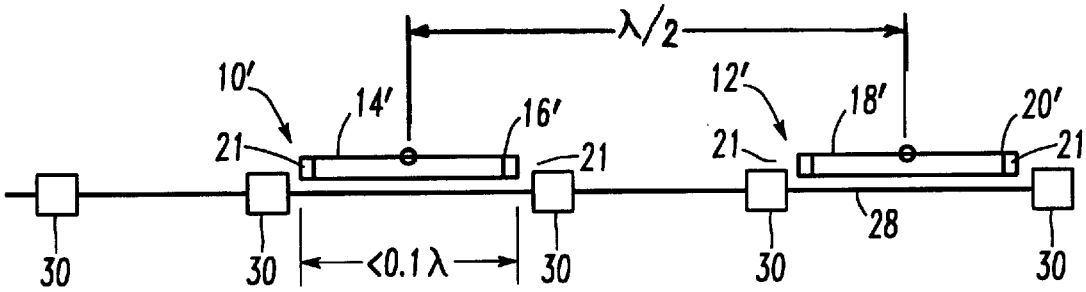
FIG. 11 is an electrical schematic diagram of a further modification of the antenna system shown in FIG. 9 depicting the preferred embodiment of the invention where the RF chokes are moved immediately adjacent the outer ends of the dipole leg elements.
Figure 10C:
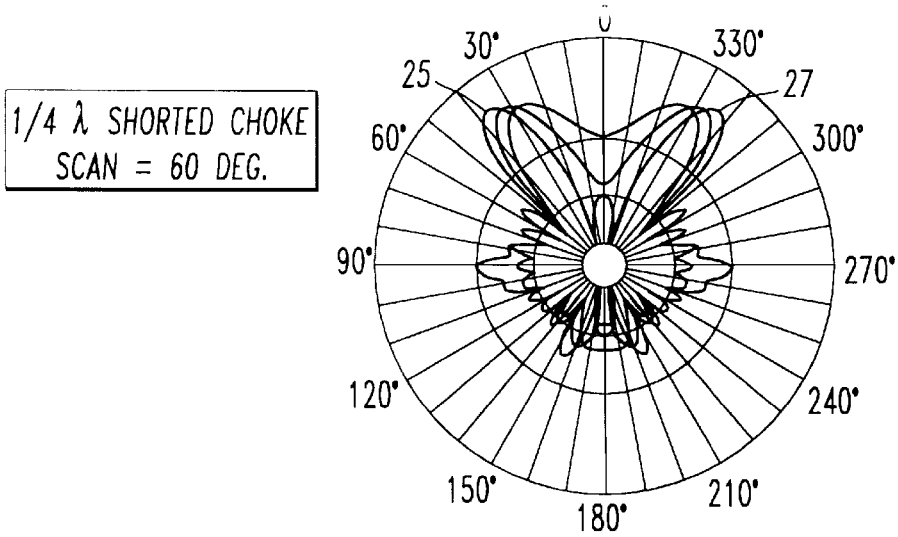
Figure 12A:
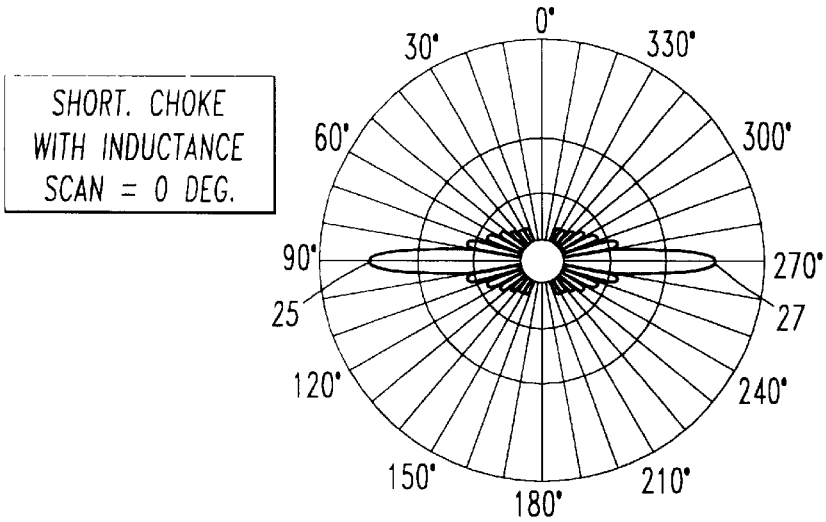
FIGS. 12A–12C depict antenna patterns for three scan angles of the embodiment of the invention shown in FIG. 11.
Figure 12B:
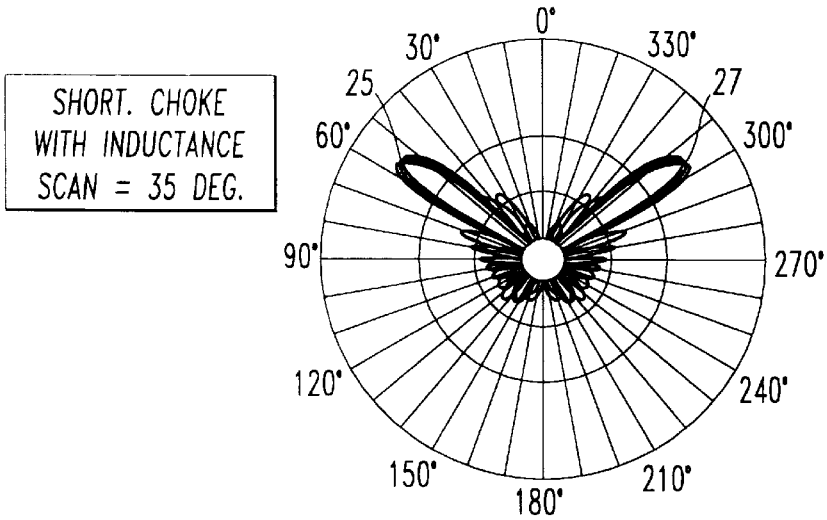
Figure 12C:
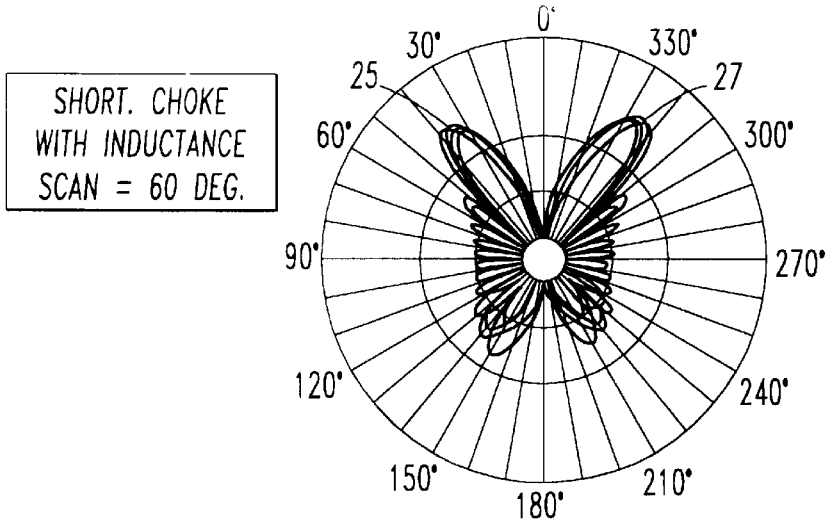

While certain improvements result, the scan pattern at 60° scan as shown in FIG. 10C still provides undesired secondary lobes. Such a condition is solved by placing RF chokes 30 immediately adjacent the outer extremities of the dipole leg elements 14', 16' and 18', 20' as shown in FIG. 11. Such an arrangement substantially improves the radiation patterns as shown in FIGS. 12A, 12B and 12C.

A block diagram and electrical schematic diagram of the preferred embodiment of such an arrangement, but now additionally including a local transmit/receive (T/R) module, is shown in FIGS. 13 and 14 while a physical representation thereof is further shown in FIG. 15.

Referring now to these figures, FIG. 13 is illustrative of an elongated cylindrical radome 11 comprised of dielectric material and in which there are located a plurality of parasitically driven active dipole antenna sections of the type shown in FIG. 11 and consisting of antenna sections 10', 12' and n'. The antenna sections, for example, sections 10' and 12' include pairs of dipole leg elements 14', 16' and 18', 20', and associated end loading coil elements 211, and 212 as shown in FIG. 11. Likewise dipole antenna section n' is comprised of the same components.

Further shown in FIG. 13, respective T/R modules $\mathbf{34}_1$, $\mathbf{34}_2$ and $\mathbf{34}_n$ are associated with the dipole antenna sections 10', 12' and n' and are independently coupled to RF transceiver apparatus, not shown, by RF feeds $\mathbf{40}_1$, $\mathbf{40}_2$, $\mathbf{40}_n$. The T/R modules $\mathbf{34}_1$, $\mathbf{34}_2$ and $\mathbf{34}_n$ are commonly powered by the same DC power line 28 consisting of conductors 30 and 32. Further as shown in FIG. 13, the DC power line 28 is also formed into RF choke pails $\mathbf{30}_1$, $\mathbf{30}_2$, $\mathbf{30}_n$ which are located immediately adjacent the T/R modules $\mathbf{34}_1$, $\mathbf{34}_2$ and $\mathbf{34}_n$, which is in relatively close proximity to the respective dipole elements.

Each RF choke 30, moreover, includes separate coil elements 42 and 44 in the conductors 31 and 32 as shown schematically in FIG. 14. This is also shown physically in FIG. 15 where the two coils 42 and 44 are formed from the conductors 31 and 32 so that they are contiguous with one another and are positioned at the ends of the T/R module $\mathbf{34}_1$.

The driven dipole elements 14' and 16' are furthermore shown in FIGS. 14 and 15 spiraled around elongated circuit boards 46 and 48 which comprise a power supply board and an RF board, respectively, and which are adapted to support the power supply circuitry 50 and the RF input/output amplifier circuitry 52 (FIG. 14) which connects to the dipole elements 14' and 16'. FIGS. 14 and 15 also depict the end loading coils 211 for the dipole leg elements 14' and 16' being wound in an opposite sense with respect to each other around the circuit boards 46 and 48. Such a configuration reduces cross polarization and the electrical length needed for resonance is achieved.

A Faraday shield assembly is also shown which is adapted to shield the RF components in each antenna section in a well known manner.

Figure 16A:
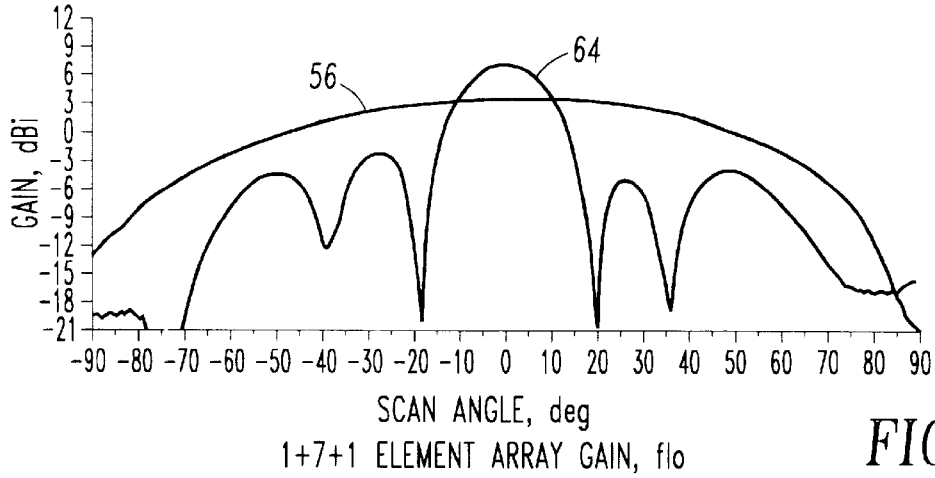
FIGS. 16A–16C are illustrative of the gain characteristic curves for the dipole antenna array in accordance with the subject invention for broadside radiation at three operational frequencies of a designated frequency band; and, FIGS. 17A–17C are illustrative of the gain characteristics for a scan angle of 60° for the same three operational frequencies of FIGS. 16A–16C.
Figure 16B:
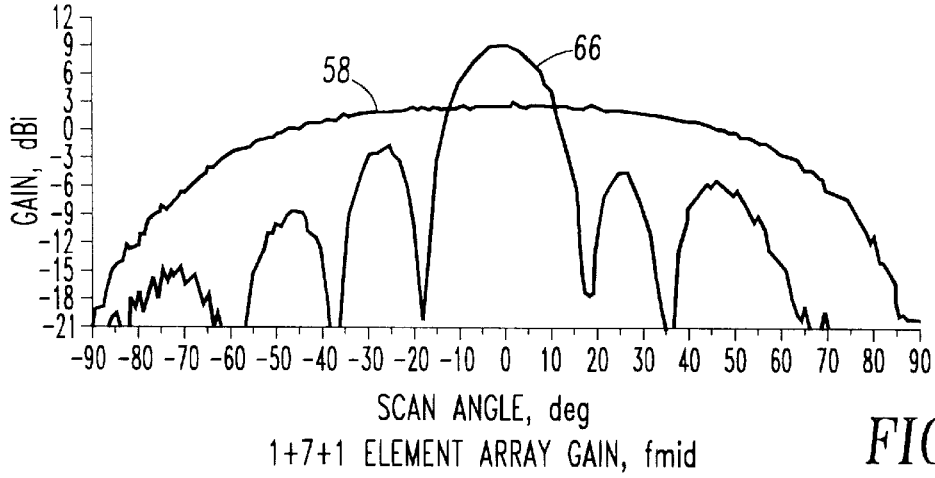
Figure 16C:
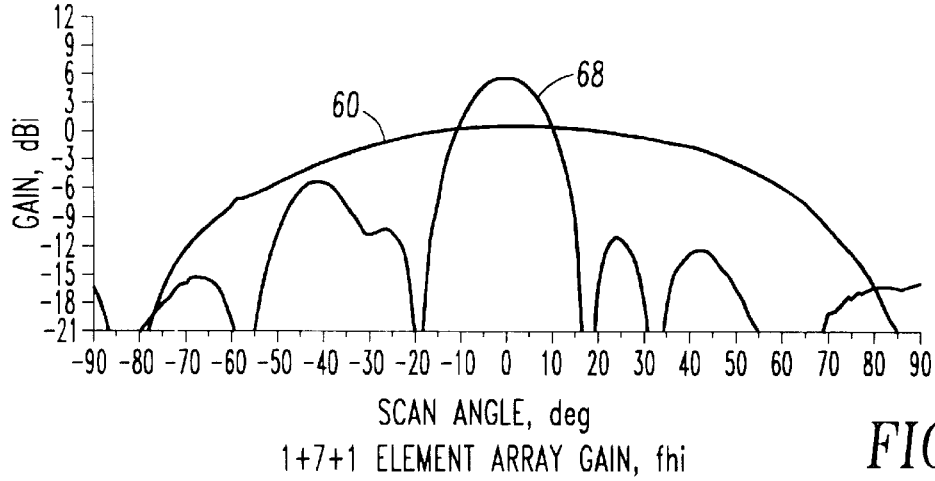
Figure 17A:
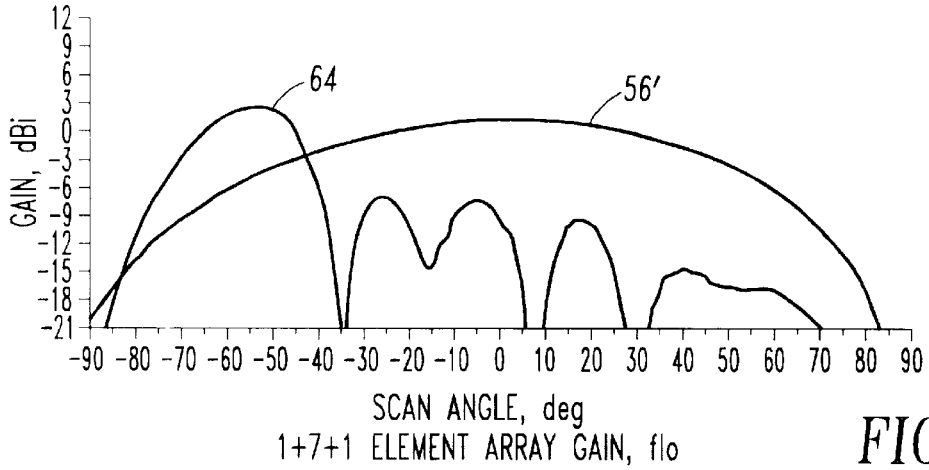
Figure 17B:
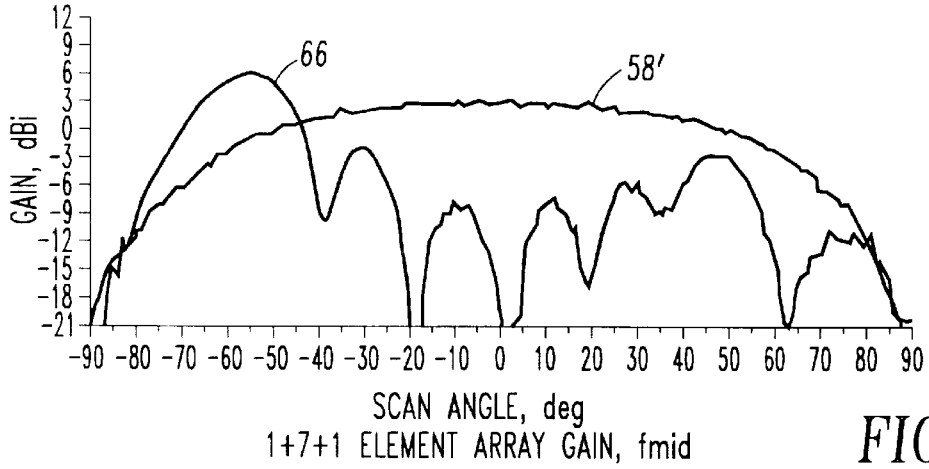
Figure 17C:
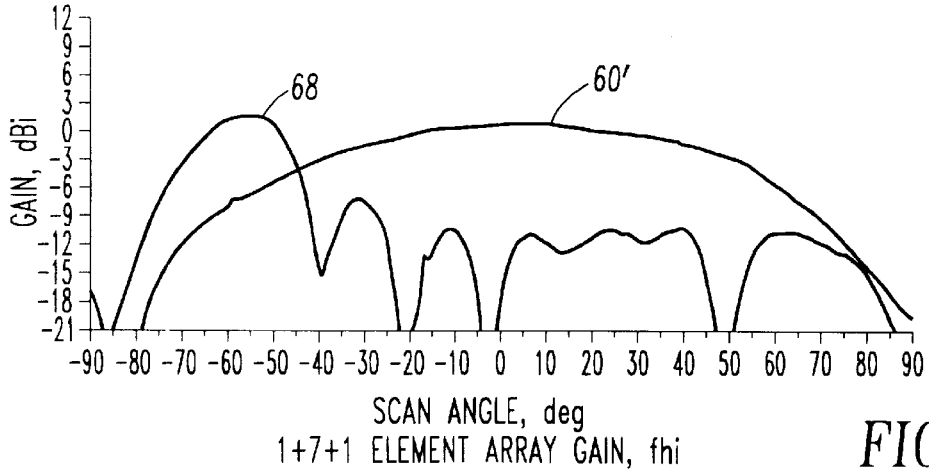

Referring now to FIGS. 16A, 16B and 16C, shown thereat is the gain characteristic for an array in accordance with the subject invention having, for example, seven active antenna sections and a dummy section at either end for broadside radiation (0° scan). The plots shown thereat provide a similar gain characteristic curve 56, 58 and 60 for three operating frequencies (LOW, MID, HIGH) within a predetermined portion of the UHF frequency band. Reference numerals 62, 64, 66 and 68 are illustrative of the broadside radiation patterns. Where the array is scanned over a 60° range as shown in FIGS. 17A, 17B and 17C, similar gain characteristics 56', 58' and 60' are realized.

Thus what has been shown and described is a steerable dipole array comprised of a plurality of active dipole antenna sections including transmit/receive modules with the DC power line powering the modules being used as part of the radiating system while for maintaining DC continuity in the DC power line.

The foregoing detailed description merely illustrates the principles of the invention. It will thus be appreciated that those skilled in the art will be able to devise various arrangements which, although not explicitly described or shown herein, embody the principles of the invention and are thus within its spirit and scope.

What is claimed is:

1. An axial dipole antenna array, comprising:

a plurality of mutually spaced apart parasitically driven dipole antenna sections arranged along a common longitudinal axis, each of said sections including, a pair of electrically short antenna dipole leg elements having an electrical length substantially less than a quarter wavelength, a respective local active transmit/receive module connected to the dipole leg elements, a continuous DC power line comprising a pair of capacitively coupled electrical conductors extending in an axial direction adjacent the dipole leg elements of said plurality of antenna sections for supplying DC power to respective transmit/receive modules thereof and including a choke circuit located adjacent the outer end of both the dipole leg elements for restricting the electrical length of the portion of the electrical conductors extending past the leg elements so that it is equal to or less than a half wavelength for reducing the mutual coupling between the DC power line and the dipole leg elements while forming a parasitic element for the respective dipole antenna section.

2. An axial dipole antenna array according to claim 1 wherein said choke circuit comprises an RF choke.

3. An axial dipole antenna array according to claim 2 wherein said RF choke comprises a quarter wavelength shorted balanced line choke.

4. An axial dipole antenna array according to claim 2 wherein said RF choke comprises a short circuited balanced line choke having an electrical length less than a quarter wavelength.

5. An axial dipole antenna array according to claim 2 wherein said RF choke comprises a short circuited balanced line choke shorter than a quarter wavelength ($\lambda/4$) and having a complex transfer function which is dependent upon the geometry of the dipole leg elements and being located immediately adjacent the outer ends of the dipole leg elements.

6. An axial dipole antenna array according to claim 5 wherein the complex transfer function includes the attributes of electrical delay and amplitude.

7. An axial dipole antenna array according to claim 5 wherein the complex transfer function comprises a lump inductance response and an associated electrical delay.

8. An axial dipole antenna array according to claim 7 wherein the electrical length of said pair of dipole leg elements is equal to or less than one tenth of a wavelength (0.1λ).

9. An axial dipole antenna array according to claim 8 and additionally including end loading circuit means at the outer ends of the dipole leg elements.

10. An axial dipole antenna array according to claim 9 wherein said end loading circuit means comprises a pair of coiled loading elements wound in an opposite sense with respect to each other.

11. An axial dipole antenna array according to claim 1 and additionally including a Faraday Shield assembly located around the transmit/receive module.

12. An axial dipole antenna array, comprising:

a plurality of parasitically driven dipole antenna sections arranged linearly along a common longitudinal axis, each of said sections including, a pair of floating dipole leg elements having an electrical length substantially equal to or less than one tenth (0.1λ), an electrically shielded active transmit/receive module connected to the dipole leg elements and located in the immediate vicinity thereof, a pair of capacitively coupled continuous electrical conductors extending in an axial direction adjacent the dipole leg elements of said plurality of antenna sections for supplying DC power to respective transmit/receive modules and including RF chokes located adjacent the outer end of both the dipole leg elements for restricting the electrical length of the portion of the electrical conductors extending past the leg elements so that it is equal to or less than a half wavelength (λ/2) for reducing the mutual coupling between the electrical conductors and the leg elements while forming a parasitic element for the respective dipole antenna section.

13. An axial dipole antenna array according to claim 12 wherein the plurality of dipole antenna sections are individually driven.

14. An axial dipole antenna array according to claim 12 and wherein the dipole leg elements additionally include end loading elements at the extremities thereof.

15. An axial dipole antenna array according to claim 14 wherein the end loading elements comprise a pair of coiled inductance type elements wound in an opposite electrical sense with respect to one another.

16. An axial dipole antenna array according to claim 15 wherein said RF choke comprises a short circuited balanced line choke shorter than a quarter wavelength (λ/4) and having a complex transfer function which is dependent upon the geometry of the dipole leg elements and being located immediately adjacent the outer ends of the dipole leg elements.

17. An axial dipole antenna array according to claim 16 wherein the complex transfer function comprises a lump inductance response and an associated electrical delay.

18. An axial dipole antenna array, comprising:

a plurality of individually driven dipole antenna sections spaced linearly along a common axis, each of said sections including, a pair of floating dipole leg elements leaving an electrical length substantially equal to or less than one tenth (0.1λ) and including end loading elements located at the extremities thereof comprising a pair of coiled elements wound in an opposite sense with respect to one another, an active transmit/receive module including Faraday shielding connected to the dipole leg elements and located in the immediate vicinity thereof, a pair of capacitively coupled continuous electrical conductors extending in an axial direction adjacent the dipole leg elements of said plurality of antenna sections for supplying DC power to respective transmit/receive modules and including RF chokes having a complex transfer function including a lump inductance response and an associated electrical delay located adjacent the outer end of both the dipole leg elements for restricting the electrical length of the portion of the electrical conductors extending past the leg elements so that it is equal to or less than a half wavelength (λ/2) for reducing the mutual coupling between the electrical conductors and the leg elements while forming a parasitic driving element for the respective dipole antenna section.

19. An axial dipole antenna array according to claim 18 wherein the plurality of dipole antenna sections are individually driven so as to provide a phased array antenna.

20. A method of forming a dipole antenna array, comprising the steps of:

(a) arranging a plurality of parasitically driven dipole antenna sections in spaced relationship along a common longitudinal axis, each of said sections including, a pair of electrically short antenna dipole leg elements having an electrical length equal to or less than one tenth wavelength (0.1λ), (b) end loading the dipole leg elements with coiled inductance type elements, (c) locating a respective active transmit/receive module in the immediate vicinity of the dipole leg elements;

(d) connecting the respective transmit/receive module to the dipole leg elements, (e) installing a pair of capacitively coupled continuous electrical conductors in the axial direction adjacent the dipole leg elements of said plurality of antenna sections for supplying DC power to the transmit/receive module, and (f) locating an RF choke adjacent the outer end of both the dipole leg elements for restricting the electrical length of the portion of the electrical conductors extending past the dipole leg elements so that it is equal to or less than a half wavelength for reducing the mutual coupling between the electrical conductors and the leg elements while forming a parasitic element for the respective dipole antenna section.

21. A method according to claim 20 wherein the step (f) of locating the RF choke comprises locating the choke immediately adjacent the outer ends of the dipole leg elements.

22. A method according to claim 21 and additionally the step (g) of forming the RF choke by using a portion of DC power conductors.

23. A method according to claim 22 wherein the RF choke has a complex transfer function.

24. A method according to claim 23 wherein the complex transfer function comprises a lump inductance response and an associated electrical delay.

25. A method according to claim 24 wherein the step (b) of end loading the dipole leg elements comprise connecting a pair of coded inductances, wound in a mutually opposite electrical sense, to the outer ends of the dipole leg elements.

* * * * *